US005918955A

United States Patent [19]

Graham

[11] Patent Number: 5,918,955

[45] Date of Patent: Jul. 6, 1999

[54] FILE SPACING AND LOCATION INDICATING DEVICE

[76] Inventor: Hilda Laverne Graham, 2910D W. Florida St., Greensboro, N.C. 27407

[21] Appl. No.: 09/137,043

[22] Filed: Aug. 20, 1998

[51] Int. Cl.[6] ..... A47B 63/00

[52] U.S. Cl. ..... 312/193; 312/348.3; 220/535

[58] Field of Search ..... 312/183, 193, 312/348.3, 351; 220/535, 538, 539

[56] References Cited

U.S. PATENT DOCUMENTS

| | | | |
|---|---|---|---|
| 5,341,945 | 8/1994 | Gibson | 108/60 X |
| 5,676,439 | 10/1997 | Occhipinti et al. | 312/183 |
| 5,690,038 | 11/1997 | Merit et al. | 108/60 |

*Primary Examiner*—Peter M. Cuomo
*Assistant Examiner*—Karlena D. Schwing

[57] ABSTRACT

A file spacing and location indicating device for spacing apart files, particularly hanging files, in a drawer and indicating their location in the drawer so that files removed from the drawer may be quickly and easily returned to their proper place in the drawer. The device includes a mounting rod having a pair of opposite end portions and an elongate portion extending between the end portions of the mounting rod. The end portions of the mounting rod are designed for mounting to a hanging rail of a hanging file system. A plurality of separators are provided each having an attachment portion and an indicator portion outwardly extending from the attachment portion. The attachment portion is generally C-shaped and has a pair of arcuate arms defining an attachment space therebetween through which the elongate portion of the mounting rod is extended. The arms of the attachment portion of each of the separators are designed for releasably holding the elongate portion of the mounting rod in the attachment space so that each of the separators is pivotable about the longitudinal axis of the elongate portion of the mounting rod.

11 Claims, 2 Drawing Sheets

FILE SPACING AND LOCATION INDICATING DEVICE

BACKGROUND OF THE INVENTION

1. Field of the Invention

The present invention relates to devices for hanging files and more particularly pertains to a new file spacing and location indicating device for spacing apart files, particularly hanging files, in a drawer and indicating their location in the drawer so that files removed from the drawer may be quickly and easily returned to their proper place in the drawer.

2. Description of the Prior Art

The use of devices for hanging files is known in the prior art. More specifically, devices for hanging files heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for hanging files include U.S. Pat. No. 4,887,873; U.S. Pat. No. 3,944,080; U.S. Pat. No. 5,287,414; U.S. Pat. No. 5,341,940; U.S. Pat. No. 5,439,280; and U.S. Pat. No. Des. 258,296.

While these devices fulfill their respective, particular objectives and requirements, the aforementioned patents do not disclose a new file spacing and location indicating device. The inventive device includes a mounting rod having a pair of opposite end portions and an elongate portion extending between the end portions of the mounting rod. The end portions of the mounting rod are designed for mounting to a hanging rail of a hanging file system. A plurality of separators are provided each having an attachment portion and an indicator portion outwardly extending from the attachment portion. The attachment portion is generally C-shaped and has a pair of arcuate arms defining an attachment space therebetween through which the elongate portion of the mounting rod is extended. The arms of the attachment portion of each of the separators are designed for releasably holding the elongate portion of the mounting rod in the attachment space so that each of the separators is pivotable about the longitudinal axis of the elongate portion of the mounting rod.

In these respects, the file spacing and location indicating device according to the present invention substantially departs from the conventional concepts and designs of the prior art, and in so doing provides an apparatus primarily developed for the purpose of spacing apart files, particularly hanging files, in a drawer and indicating their location in the drawer so that files removed from the drawer may be quickly and easily returned to their proper place in the drawer.

SUMMARY OF THE INVENTION

In view of the foregoing disadvantages inherent in the known types of devices for hanging files now present in the prior art, the present invention provides a new file spacing and location indicating device construction wherein the same can be utilized for spacing apart files, particularly hanging files, in a drawer and indicating their location in the drawer so that files removed from the drawer may be quickly and easily returned to their proper place in the drawer.

The general purpose of the present invention, which will be described subsequently in greater detail, is to provide a new file spacing and location indicating device apparatus and method which has many of the advantages of the devices for hanging files mentioned heretofore and many novel features that result in a new file spacing and location indicating device which is not anticipated, rendered obvious, suggested, or even implied by any of the prior art devices for hanging files, either alone or in any combination thereof.

To attain this, the present invention generally comprises a mounting rod having a pair of opposite end portions and an elongate portion extending between the end portions of the mounting rod. The end portions of the mounting rod are designed for mounting to a hanging rail of a hanging file system. A plurality of separators are provided each having an attachment portion and an indicator portion outwardly extending from the attachment portion. The attachment portion is generally C-shaped and has a pair of arcuate arms defining an attachment space therebetween through which the elongate portion of the mounting rod is extended. The arms of the attachment portion of each of the separators are designed for releasably holding the elongate portion of the mounting rod in the attachment space so that each of the separators is pivotable about the longitudinal axis of the elongate portion of the mounting rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new file spacing and location indicating device apparatus and method which has many of the advantages of the devices for hanging files mentioned heretofore and many novel features that result in a new file spacing and location indicating device which is not anticipated, rendered obvious, suggested, or even implied by any of the prior art devices for hanging files, either alone or in any combination thereof.

It is another object of the present invention to provide a new file spacing and location indicating device which may be easily and efficiently manufactured and marketed.

It is a further object of the present invention to provide a new file spacing and location indicating device which is of a durable and reliable construction.

An even further object of the present invention is to provide a new file spacing and location indicating device which is susceptible of a low cost of manufacture with regard to both materials and labor, and which accordingly is then susceptible of low prices of sale to the consuming public, thereby making such file spacing and location indicating device economically available to the buying public.

Still yet another object of the present invention is to provide a new file spacing and location indicating device which provides in the apparatuses and methods of the prior art some of the advantages thereof, while simultaneously overcoming some of the disadvantages normally associated therewith.

Still another object of the present invention is to provide a new file spacing and location indicating device for spacing apart files, particularly hanging files, in a drawer and indicating their location in the drawer so that files removed from the drawer may be quickly and easily returned to their proper place in the drawer.

Yet another object of the present invention is to provide a new file spacing and location indicating device which includes a mounting rod having a pair of opposite end portions and an elongate portion extending between the end portions of the mounting rod. The end portions of the mounting rod are designed for mounting to a hanging rail of a hanging file system. A plurality of separators are provided each having an attachment portion and an indicator portion outwardly extending from the attachment portion. The attachment portion is generally C-shaped and has a pair of arcuate arms defining an attachment space therebetween through which the elongate portion of the mounting rod is extended. The arms of the attachment portion of each of the separators are designed for releasably holding the elongate portion of the mounting rod in the attachment space so that each of the separators is pivotable about the longitudinal axis of the elongate portion of the mounting rod.

Still yet another object of the present invention is to provide a new file spacing and location indicating device that reduces the time spent trying to return a file in a drawer to the proper position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
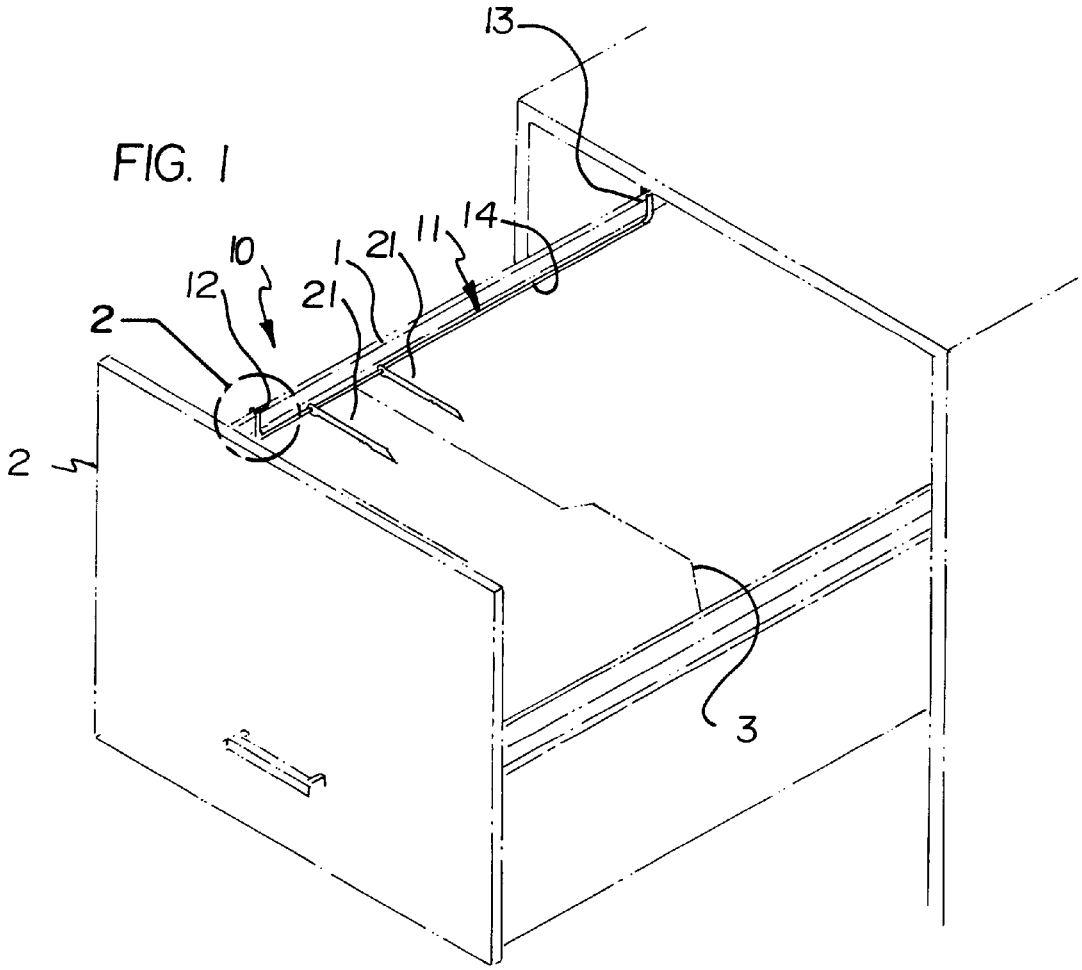
FIG. 1 is a schematic perspective view of a new file spacing and location indicating device according to the present invention.
Figure 2:
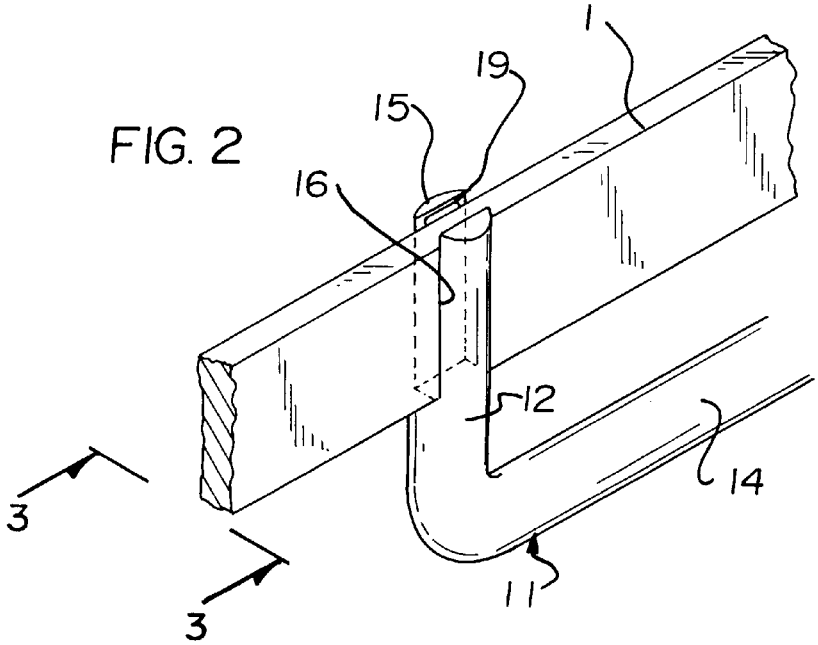
FIG. 2 is a schematic perspective view of the present invention taken from the vantage of circle 2 on FIG. 1.
Figure 3:
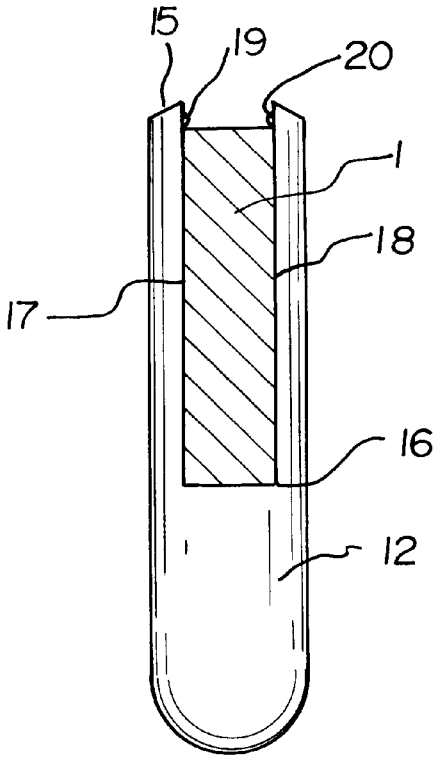
FIG. 3 is a schematic side view of the present invention taken from line 3—3 of FIG. 2.
Figure 4:
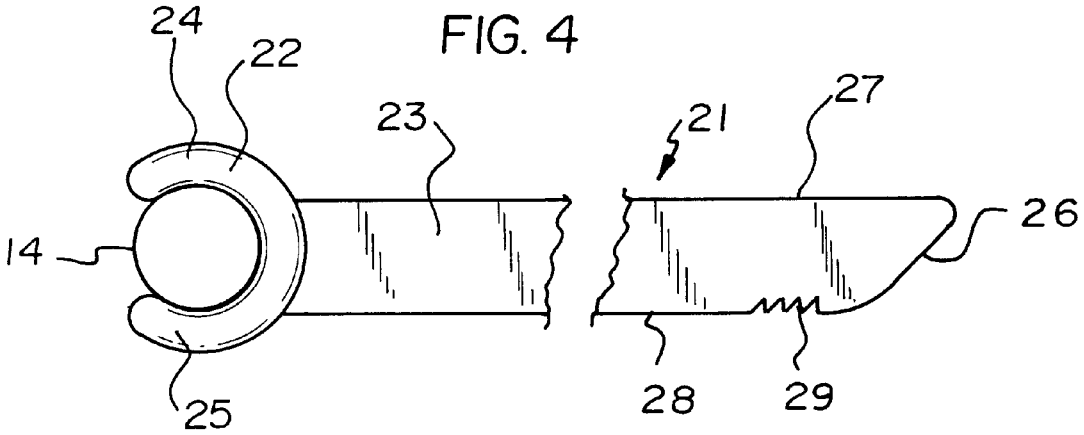
FIG. 4 is a schematic side view of a separator of the present invention.

With reference now to the drawings, and in particular to FIGS. 1 through 4 thereof, a new file spacing and location indicating device embodying the principles and concepts of the present invention and generally designated by the reference numeral 10 will be described.

The file spacing and location indicating device 10 is for mounting on an elongate hanging rail 1 of a hanging file system in a drawer 2 for spacing apart files 3 in the drawer 2 and indicating the position of a removed file 3 in the drawer 2. As best illustrated in FIGS. 1 through 4, the file spacing and location indicating device 10 generally comprises a mounting rod 11 having a pair of opposite end portions 12,13 and an elongate portion 14 extending between the end portions 12,13 of the mounting rod 11. The end portions 12,13 of the mounting rod 11 are designed for mounting to a hanging rail 1 of a hanging file system. A plurality of separators 21 are provided each having an attachment portion 22 and an indicator portion 23 outwardly extending from the attachment portion 22. The attachment portion 22 is generally C-shaped and has a pair of arcuate arms 24,25 defining an attachment space therebetween through which the elongate portion 14 of the mounting rod 11 is extended. The arms 24,25 of the attachment portion 22 of each of the separators 21 are designed for releasably holding the elongate portion 14 of the mounting rod 11 in the attachment space so that each of the separators 21 is pivotable about the longitudinal axis of the elongate portion 14 of the mounting rod 11.

Specifically, a mounting rod 11 has a pair of opposite end portions 12,13 and an elongate portion 14 extending between the end portions 12,13 of the mounting rod 11. The elongate portion 14 of the mounting rod 11 has a longitudinal axis. Each of the end portions 12,13 of the mounting rod 11 has a longitudinal axis. The end portions 12,13 of the mounting rod 11 is outwardly extended from the longitudinal axis of the mounting rod 11 such that the longitudinal axes of the of the end portion generally lie in a common plane. The longitudinal axes of the end portions 12,13 are extended generally perpendicularly to the longitudinal axis of the elongate portion 14 of the mounting rod 11. The end portions 12,13 and the elongate portion 14 each preferably has a generally circular cross section taken substantially perpendicular to their respective longitudinal axis.

Each of the end portions 12,13 of the mounting rod 11 has a terminus 15. Each of the end portions 12,13 has an elongate mounting slot 16 extending from the terminus 15 of the end portion towards the elongate portion 14 of the mounting rod 11. The end portions 12,13 of the mounting rod 11 are designed for mounting to a hanging rail 1 of a hanging file system such that the elongate portion 14 of the mounting rod 11 depends from the hanging rail 1. The mounting slots 16 of the end portions 12,13 is designed for receiving the hanging rail 1 of the hanging file system therein. The mounting slot 16 of each of the end portions 12,13 has a pair side walls 17,18 extending generally parallel to each other. Each of the side walls 17,18 has an attachment protrusion 19,20 extending into the mounting slot 16. The attachment protrusions 19,20 facing each other and is positioned adjacent the terminus of the associated end portion. The attachment protrusions 19,20 is designed for releasably holding the hanging rail 1 in the mounting slot 16.

The device 10 also includes a plurality of file separators 21. Each of the separators 21 has an attachment portion 22 and an elongate indicator portion 23 outwardly extending from the attachment portion 22. The attachment portion 22 and the indicator portion 23 generally lie in a common plane. Ideally, the attachment portion 22 has a generally circular cross section and the indicator portion 23 is generally flat with a generally rectangular cross section. The attachment portion 22 is generally C-shaped and has a pair of arcuate arms 24,25 defining an attachment space therebetween. The elongate portion 14 of the mounting rod 11 is extended through the attachment space of each of separators 21. The arms 24,25 of the attachment portion 22 of each of the separators 21 are designed for releasably holding the elongate portion 14 of the mounting rod 11 in the attachment space such that each of the separators 21 is pivotable about the longitudinal axis of the elongate portion 14 of the mounting rod 11. This releasable holding permitting a user to snap the separators 21 on and off of the elongate portion 14 of the mounting rod 11.

The planes of the separators 21 are preferably extended generally perpendicularly from the longitudinal axis of the elongate portion 14 of the mounting rod 11. In this preferred embodiment, the planes of the separators 21 are also preferably generally parallel to one another.

The indicator portion 23 of each of the separators 21 has a tip edge 26, generally straight top and bottom edges 27,28, and a longitudinal axis extending between the attachment portion 22 and the top edge 27 of the indicator portion 23. The tip edge 26 of the indicator portion 23 is extended along a line extended at an obtuse angle to the longitudinal axis of the indicator portion 23. The bottom edge 28 of the indicator portion 23 has a plurality of generally triangular notches 29 positioned towards the tip edge 26 of the indicator portion 23 (although it is also possible for the notches 29 to extend in a row along the length of the bottom edge 28).

Preferably, the elongate portion 14 of the mounting rod 11 has a length greater than about 3 inches, and the end portions 12,13 of the mounting rod 11 each have a length greater than about 1 inch. In an ideal illustrative embodiment, the elongate portion 14 of the mounting rod 11 has a length of about 6 inches, Ideally, the end portions 12,13 of the mounting rod 11 each have a length of about 2½ inches.

In use, the separators 21 are designed for extending from the mounting rod 11 towards the middle of the drawer 2 and so that a file 3 may be positioned between adjacent pairs of separators 21 to separate the files 3 in the drawer 2 from one another. The separators 21 are pivotable from a generally horizontal position to a raised position above the tops of the files 3 to help indicate the location of a removed file 3.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for mounting on an elongate hanging rail of a hanging file system in a drawer for spacing apart files in the drawer and indicating the position of a removed file in the drawer, said device comprising:

a mounting rod having a pair of opposite end portions and an elongate portion extending between said end portions of said mounting rod;

said elongate portion of said mounting rod having a longitudinal axis;

each of said end portions of said mounting rod having a longitudinal axis;

said end portions of said mounting rod being adapted for mounting to the hanging rail of the hanging file system;

a plurality of separators, each of said separators having an attachment portion and an indicator portion extending from said attachment portion;

said attachment portion of each said separators being generally C-shaped and having a pair of arms defining an attachment space therebetween, said elongate portion of said mounting rod being extended through said attachment space; and said arms of said attachment portion of each of said separators being adapted for holding said elongate portion of said mounting rod in said attachment space such that each of said separators is pivotable about said longitudinal axis of said elongate portion of said mounting rod.

2. The device of claim 1, wherein said end portions of said mounting rod are outwardly extended from said longitudinal axis of said mounting rod such that said longitudinal axes of said end portions generally lie in a common plane.

3. The device of claim 1, wherein said longitudinal axes of said end portions are extended generally perpendicularly to said longitudinal axis of said elongate portion of said mounting rod.

4. The device of claim 1, wherein said end portions and said elongate portion each have a generally circular cross section taken substantially perpendicular to their respective longitudinal axis.

5. The device of claim 1, wherein each of said end portions of said mounting rod has a terminus, each of said end portions having an elongate mounting slot extending from said terminus of said end portion towards said elongate portion of said mounting rod, wherein said mounting slots of said end portions is adapted for receiving the hanging rail of the hanging file system therein.

6. The device of claim 5, wherein said mounting slot of each of said end portions has a pair of side walls extending generally parallel to each other, each of said side walls having an attachment protrusion extending into said mounting slot, said attachment protrusions facing each other and being positioned adjacent the terminus of the associated end portion, said attachment protrusions being for holding the hanging rail in the mounting slot.

7. The device of claim 1, wherein said attachment portion and said indicator portion of each said separator generally lie in a common plane.

8. The device of claim 7, wherein said planes of said separators are extended generally perpendicularly from said longitudinal axis of said elongate portion of said mounting rod, and wherein said planes of said separators are generally parallel to one another.

9. The device of claim 1, wherein said indicator portion of each of said separators has a tip edge, top and bottom edges, and a longitudinal axis extending between said attachment portion and said top edge of said indicator portion, said tip edge of said indicator portion being extended along a line extended at an obtuse angle to said longitudinal axis of said indicator portion.

10. The device of claim 9, wherein said bottom edge of said indicator portion of each said separator has a plurality of notches positioned towards said tip edge of said indicator portion.

11. A device for mounting on an elongate hanging rail of a hangin file system in a drawer for spacing apart files in the drawer and indicating the position of a removed file in the drawer, said device comprising:

a mounting rod having a pair of opposite end portions and an elongate portion extending between said end portions of said mounting rod;

said elongate portion of said mounting rod having a longitudinal axis;

each of said end portions of said mounting rod having a longitudinal axis;

said end portions of said mounting rod being outwardly extended from said longitudinal axis of said mounting rod such that said longitudinal axes of said end portions generally lie in a common plane;

said longitudinal axes of said end portions being extended generally perpendicularly to said longitudinal axis of said elongate portion of said mounting rod;

said end portions and said elongate portion each having a generally circular cross section taken substantially perpendicular to their respective longitudinal axis;

each of said end portions of said mounting rod having a terminus, each of said end portions having an elongate mounting slot extending from said terminus of said end portion towards said elongate portion of said mounting rod;

said end portions of said mounting rod being adapted for mounting to the hanging rail of the hanging file system, said mounting slots of said end portions being adapted for receiving the hanging rail of the hanging file system therein;

said mounting slot of each of said end portions having a pair side walls extending generally parallel to each other, each of said side walls having an attachment protrusion extending into said mounting slot, said attachment protrusions facing each other and being positioned adjacent the terminus of the associated end portion, said attachment protrusions being for holding the hanging rail in the mounting slot;

a plurality of separators, each of said separators having an attachment portion and an elongate indicator portion outwardly extending from said attachment portion, said attachment portion and said indicator portion generally lying in a common plane;

said attachment portion of each said separator being generally C-shaped and having a pair of arcuate arms defining an attachment space therebetween, said elongate portion of said mounting rod being extended through said attachment space;

said arms of said attachment portion of each of said separators being adapted for releasably holding said elongate portion of said mounting rod in said attachment space such that each of said separators is pivotable about said longitudinal axis of said elongate portion of said mounting rod;

said planes of said separators being extended generally perpendicularly from said longitudinal axis of said elongate portion of said mounting rod, said planes of said separators being generally parallel to one another;

said indicator portion of each of said separators having a tip edge, top and bottom edges, and a longitudinal axis extending between said attachment portion and said top edge of said indicator portion;

said tip edge of said indicator portion of each said separator being extended along a line extended at an obtuse angle to said longitudinal axis of said indicator portion; and said bottom edge of said indicator portion of each said separator having a plurality of notches positioned towards said tip edge of said indicator portion.

* * * * *